US005529705A

United States Patent [19]

Small, Jr. et al.

[11] Patent Number: 5,529,705

[45] Date of Patent: Jun. 25, 1996

[54] METHODS FOR PREPARING NORMAL AND OVERBASED PHENATES

[75] Inventors: Vernon R. Small, Jr., Rodeo; William W. Willis, Jr., Pinole, both of Calif.; Jean L. Le Coent, Le Havre, France

[73] Assignee: Chevron Chemical Company, San Ramon, Calif.

[21] Appl. No.: 406,336

[22] Filed: Mar. 17, 1995

[51] Int. Cl.[6] ..... C10M 159/22

[52] U.S. Cl. ..... 252/25; 252/42.7

[58] Field of Search ..... 252/18, 25, 42.7

[56] References Cited

U.S. PATENT DOCUMENTS

| | | | |
|---|---|---|---|
| Re. 26,811 | 3/1970 | Cohen | 252/37.2 |
| 2,680,096 | 6/1954 | Walker et al. | 252/42.7 |
| 3,178,368 | 4/1965 | Hanneman | 252/33.4 |
| 3,367,867 | 2/1968 | Abbott et al. | 252/33.4 |
| 3,372,116 | 3/1968 | Meinhardt | 252/42.7 |
| 3,410,798 | 11/1968 | Cohen | 252/18 |
| 3,437,595 | 4/1969 | Coupland | 252/427 |
| 3,493,516 | 2/1970 | Allphin et al. | 252/33.3 |
| 3,801,507 | 4/1974 | Hendrickson et al. | 252/42 F |
| 3,810,837 | 5/1974 | Chafetz et al. | 252/18 |
| 3,923,670 | 12/1975 | Crawford | 252/42.7 |
| 4,049,560 | 9/1977 | Dominey | 252/33.3 |
| 4,608,184 | 8/1986 | Chang | 252/42.7 |
| 4,744,921 | 5/1988 | Liston | 252/42.7 |
| 5,035,816 | 7/1991 | Leone | 252/40.5 |

FOREIGN PATENT DOCUMENTS

| | | | |
|---|---|---|---|
| 0271262A1 | 6/1988 | European Pat. Off. | C10M 159/22 |
| 0273588A1 | 7/1988 | European Pat. Off. | C10M 159/22 |

*Primary Examiner*—Jacqueline V. Howard
*Attorney, Agent, or Firm*—E. A. Schaal

[57] ABSTRACT

Processes for preparing normal and overbased calcium sulfurized alkylphenates. The processes are characterized by a sulfurization reaction using a lower carboxylic acid catalyst which does not use a polyol promoter, e.g., ethylene glycol. The process affords a calcium sulfurized phenate product which is essentially free of polyol oxidation products. The products are useful as additives for lubricating oils.

21 Claims, No Drawings

METHODS FOR PREPARING NORMAL AND OVERBASED PHENATES

BACKGROUND OF THE INVENTION

This invention relates to processes and methods for preparing calcium, normal and overbased sulfurized alkylphenate compositions which are substantially free of the oxidation products of polyol promoters. In a further aspect the invention relates to lubricating compositions and concentrates containing such compositions.

Group II metal overbased sulfurized alkylphenate compositions (sometimes referred to as "overbased phenates") are useful lubricating oil additives which impart detergency and dispersancy properties to the lubricating oil composition as well as providing for an alkalinity reserve in the oil. Alkalinity reserve is necessary in order to neutralize acids generated during engine operation. Without this alkalinity reserve, the acids so generated would result in harmful engine corrosion.

The preparation of overbased phenates is well known in the art and is described, for example, in U.S. Pat. Nos. 2,680,096; 3,178,368; 3,367,867; 3,801,507; and the like. The disclosures of each are incorporated herein by reference in their entirety. Typically, overbased phenates have been prepared by combining under elevated temperatures an alkylphenol, a neutral or overbased hydrocarbyl sulfonate, a high molecular weight alcohol, lubricating oil, a Group II metal oxide, hydroxide or a $C_1$ to $C_6$ alkoxide sulfur and a polyol promoter, typically an alkylene glycol, to the heated mixture. The water of reaction is removed and carbon dioxide added. Uncombined $CO_2$ is removed and the reaction vessel is then further heated under vacuum to remove the alkylene glycol, water and the high molecular weight alcohol. The product is overbased by incorporation therein of hydrated lime and carbon dioxide. Typically an alkylene glycol is used to promote both the neutralization and sulfurization and also to facilitate overbasing.

However, a problem is encountered when the alkylene glycol or other polyol promoter is employed in the presence of significant amounts of sulfur. Specifically, under such reaction conditions, the alkylene glycol or other polyol promoter is oxidized (for example, ethylene glycol is oxidized to the calcium salt of oxalic acid) while the sulfur is reduced to hydrogen sulfide. Such oxidation products are known to be detrimental to engine life. For example, U.S. Pat. No. 4,608,184 discloses that calcium oxalate (an oxidation product of ethylene glycol) adversely effects engine performance as measured by the Caterpillar 1G2 test and suggests a sulfurized phenate synthesis which reduces the amount of calcium oxalate by adding the sulfur to a reaction product mix of a calcium base, alkylphenol and glycol.

U.S. Pat. No. 4,744,921 discloses a method for preparing high TBN Group II metal overbased sulfurized alkylphenate compositions containing less than 10 mole percent unsulfurized alkylphenate which has reduced sediments and exhibits better hydrolytic ability. Sulfurization is conducted using certain sulfurization catalysts without a polyol promoter. The sulfurized phenate is subsequently overbased using an alkylene glycol promoter. The patent does not consider unreacted sulfur or whether the overbasing reaction mixture, using glycol, contains elemental sulfur.

The process suffers from the disadvantage that the preferred organic sulfurization catalysts are very expensive.

U.S. Pat. Nos. 3,437,595 and 3,923,670 disclose processes wherein sulfurization is conducted without a polyol promoter by using either certain basic catalyst in the case of U.S. Pat. No. 3,437,595 as in the case of U.S. Pat. No. 3,923,670 an amount of an alkali metal hydroxide in excess of a catalytic amount. Overbasing follows using glycol and carbon dioxide. Neither patent considers unreacted sulfur and in the case of the process described in U.S. Pat. No. 3,923,670 and the preferred process described in U.S. Pat. No. 3,437,595, the process suffers from the fact that the product contains undesirable alkali metal residues. The use of separation procedures to remove the alkali metal residues from the normal sulfurized phenate is economically undesirable and in some instances the separation procedure introduces problems which interfere with the overbasing process or produce an inferior overbased product.

In the typical preparation of overbased phenates using a polyol, typically ethylene glycol, the polyol is believed to function as a phase transfer agent and/or an activating agent for the alkaline earth metal base in the sulfurization neutralization, and overbasing reactions. It is also known to the prior art that the neutralization can be catalyzed by certain low molecular weight carboxyl acids such as formic and acetic acid or mixtures thereof without the use of a polyol promoter. However, even where a low molecular weight carboxyl acid was used in the sulfurization reaction, a polyol promoter or a lower monohydric alcohol was also used. Thus, regardless of whatever process benefits were obtained by using a carboxylic acid catalyst, deleterious oxidation products were still produced if a polyol promoter was used.

On the other hand if a monohydric lower alcohol promoter were used in place of the polyol promoter, reaction rates necessarily suffered because lower reaction temperatures must be used because of the low boiling point of the alcohol promoter; particularly as the reaction is advantageously conducted at atmospheric pressure or under vacuum to reduce foaming.

U.S. Pat. No. 3,493,516 discloses a process for preparing sulfurized overbased alkaline earth metal alkyl phenates by combining a sulfurized alkyl phenol with lime at elevated temperatures according to known processes and incorporating into the composition a small amount of relatively low molecular weight carboxylic acid or mixtures thereof to form a calcium carboxylate. The patent teaches that the calcium salt of the low molecular weight carboxylic acid may be prepared in situ or prepared prior to introduction into the phenate composition or alternatively, sulfur and alkyl phenol may be added to the reaction mixture in place of the sulfurized alkyl phenol. The patent teaches that the reaction mixture further contains a high molecular weight alcohol and a polyether alcohol of 2–3 carbon atoms usually ethylene or propylene glycol. Illustrative low molecular weight carboxylic acids described in this patent include formic acid, acetic acid, glycolic acid, glyoxylic acid, propionic acid, maleic acid, etc. Examples 1 and 2 of this Patent describe a sulfurization-neutralization reaction between tetrapropenylphenol, lime and sulfur which is conducted in tridecyl alcohol and glycol in the presence of a mixture of formic acid and glycolic acid.

U.S. Pat. No. Re. 26,811 discloses a process for preparing basic sulfurized phenates and salicylates which comprises reacting at a temperature above 150° C., (A) a phenol or an alkali metal or alkaline earth metal salt thereof, (B) sulfur and (C) an alkaline earth base, in the presence of (D) a carboxylic acid or an alkali metal, alkaline earth metal, zinc or lead salt thereof, and (E) a compound of a formula $(ROR')_xOH$, wherein R is hydrogen or alkyl, R' is alkyl and x is an integer which is at least two if R is hydrogen and at least one if R is alkyl. At column 3, lines 52–55 the patent teaches that the amount of carboxylic acid or salt to be used is generally about 5–20 mole percent preferably about 5–10 mole percent of the amount of phenol in the reaction mixture. Examples of carboxylic acids and salts are set forth by the patent at column 3, lines 38–51 and include formic acid, acetic acid, propionic acid, acrylic acid, capric acid, stearic acid, maleic acid, etc., and salts such as sodium acetate, lithium acetate, potassium stearic, calcium formate, calcium acetate, calcium salt of polyisobutene-substituted succinic acid, zinc acetate, lead propionate and lead caprate. Aliphatic acids containing 2–6 carbon atoms and alkaline earth metals salts thereof, and especially acetic acid and the calcium acetate, are described as preferred. Thus although a carboxylic acid is used, the sulfurization is still conducted in the presence of a polyol promoter; i.e. $(ROR')_xOH$.

U.S. Pat. No. 4,049,560 discloses a process for preparing an overbased magnesium sulfurized phenate which comprises introducing carbon dioxide into a reaction mixture comprising a. 15–40 wt % of a sulfurized phenol or thiophenol containing one or more hydrocarbyl substituents, or a phenol or thiophenol containing one or more hydrocarbyl substituents, or said phenol or thiophenol containing one or more hydrocarbyl substituents together with sulfur.

b. 5–15 wt % of an organic sulfonic acid, an organic sulphonate or an organic sulphate, c. 5–15 wt % of a glycol, a $C_1$ to $C_5$ monohydric alkanol or $C_2$ to $C_6$ alkoxy alkanol, d. 2–15 wt % of a magnesium hydroxide or active magnesium oxide, e. at least 0.1 wt % of a $C_1$ to $C_{18}$ carboxylic acid, an anhydride thereof, or an ammonium, an amine salt, a Group I metal or a Group II metal salt of said $C_1$ to $C_{18}$ carboxylic acid, and f. at least 10% by weight of a diluent oil (including any present in components (a) and (b)).

The carboxylic acid is described as a promoter and is preferably used in an amount of 0.5 to 2.0% by weight and preferably is formic acid, acetic acid, propionic acid, or a butyric acid. But, the reaction mixture also contains a polyol promoter, i.e., a glycol or alkoxyalkanol, or contains a lower monohydric alkanol.

U.S. Pat. No. 5,035,816 discloses a process for preparing sulfurized overbased alkyl salicylates which comprises neutralizing an alkyl phenol with an alkaline earth base in the presence of at least one acid selected from $C_1$ to $C_{18}$ aliphatic carboxylic acid, benzoic acid, benzoic anhydride or mineral acids in the presence of an azeotropic solvent followed by a carboxylation of the neutralized reaction product and sulfurization with sulfur in ethylene glycol. With respect to the neutralization step the patent teaches that $C_1$ to $C_3$ aliphatic carboxylic acids, and especially their mixtures, for example the formic acid-acetic acid mixture according to an acetic/formic acid ratio which can range from 0.01/1 to 5/1, preferably from 0.25/1 to 2/1, and especially on the order of 1/1 are preferred. (See column 2, lines 53–58)

European Patent Application 271262 published Jun. 15, 1988 discloses a process for preparing sulfurized based hydrocarbyl phenates which comprises reacting either a hydrocarbyl phenol or a hydrocarbyl phenol and sulfur with an alkaline earth metal base and at least one carboxylic acid having at least carbon atoms in or with (c) either a polyhydric alcohol or an alkyl glycol, alkyl glycol ether, or polyalkylene glycol alkyl ether. The patent further teaches that when using a glycol or glycol ether, it is preferred to use in combination therewith an inorganic halide, for example ammonium chloride, and a lower, i.e., $C_1$ to $C_4$, carboxylic acid, for example acetic acid.

European Patent Application 0273588 published Jul. 6, 1988 discloses a process for increasing the TBN of an alkaline earth alkyl phenate which comprises reacting at elevated temperature a sulfurized alkaline earth metal hydrocarbyl phenate, an alkaline earth metal base, a carboxylic acid having at least carbon atoms and either a polyhydric alcohol having 2 to 4 carbon atoms, (di- or tri-) ($C_2$ to $C_4$) glycol, alkyl glycol, alkyl glycol ether or a polyalkylene glycol alkyl ether.

SUMMARY OF THE INVENTION

The present invention is based, in part, on our discovery that calcium sulfurized alkylphenates can be advantageously prepared without the use of a polyol or lower alkanol sulfurization promoter by conducting the sulfurization-neutralization in the presence of a lower molecular weight alkanoic acid, i.e., formic acid, acetic acid or propionic acid, or a mixture of lower alkanoic acids. Because a polyol promoter is not used, the resulting normal or slightly overbased sulfurized phenate product is free of polyol oxalates or other deleterious byproducts of a polyol promoter. The reaction further provides for the effective consumption of virtually all of the elemental sulfur present in the reaction mixture. This is especially important where a high TBN overbased product is desired because the overbasing reaction generally requires a polyol promoter, e.g., alkylene glycol. Thus it is important to ensure that significant amounts of elemental sulfur are not present in the overbasing reaction mixture which would promote the formation of glycol oxidation products.

Both the normal and overbased sulfurized phenates produced by the present processes are useful as lubricating oil additives to provide acid neutralization capacity and improved detergency, and to a lesser extent antioxidancy, viscosity control and friction reduction and, based on preliminary testing, exhibit improved thermal stability. As well as reduced sediments, e.g., oxalates, the present process facilitates the use of higher sulfurization reaction temperatures resulting in higher reaction rates. Accordingly, the present process provides increased process efficiency, reduced reactor resident time and reduced capital equipment costs both in terms of reactor capacity and filtration costs.

Therefore, in one aspect, the invention provides an economical process for preparing normal and overbased calcium sulfurized alkylphenates compositions which are free of polyol promoter oxidation products, which process comprises reacting an alkylphenol with sulfur in the presence of a lower carboxylic acid promoter and at least a stoichiometric amount of calcium base, for example, calcium hydroxide, in the absence of a polyol promoter. Higher TBN products can be prepared by reacting the reaction product with carbon dioxide, in the presence of an alkylene glycol, preferably ethylene glycol, and preferably in the presence of a neutral or overbased sulfonate or an alkenyl succinimide. Additional calcium base can be added in this step and/or excess calcium base can be used in the neutralization step. Similarly, where a sulfonate or alkenyl succinimide is used, it may be added in the overbasing step or added to the sulfurization step and carried through to the overbasing step. As above noted, significant amounts of polyol oxidation products are not produced in the overbasing step because if the sulfurization reaction has been properly conducted, all of the elemental sulfur will have been consumed and at most only trace amounts of elemental sulfur will be carried over to the overbasing reaction mixture. The presence of elemental sulfur is also deleterious in the final lubricating oil additive product because it promotes corrosion and staining of metal bearings, particularly copper bearings.

In further aspects, the process of the invention provides an additive concentrate, free of polyol oxidation byproducts, comprising a normal or moderately overbased calcium sulfurized alkylphenate prepared by the above process and a minor amount of a compatible diluent and a lubricating oil composition comprising a minor amount of the aforementioned normal or moderately overbased sulfurized alkylphenate concentrate and a major amount of an oil of lubricating viscosity.

In another aspect, the process of the invention provides an additive concentrate, substantially free of polyol promoter oxidation products, comprising a major amount of a high TBN overbased calcium sulfurized alkylphenate, prepared by the above process wherein a stoichiometric excess of calcium base is used and wherein following essentially complete consumption of the sulfur in the sulfurization step, the sulfurized phenate is treated with carbon dioxide in the presence of polyol promoter and additional calcium base if desired, and a minor amount of a compatible liquid diluent and a lubricating oil composition comprising a minor amount of said high TBN overbased calcium sulfurized alkylphenate and a major amount of an oil of lubricating viscosity.

Further aspects of the invention will be apparent from the following description.

FURTHER DESCRIPTION OF THE INVENTION AND PREFERRED EMBODIMENTS

Prior to discussing the invention in further detail, the following terms will be defined:

DEFINITIONS

As used herein, the following terms have the following meanings unless expressly stated to the contrary:

The term "Group II metal" or "alkaline earth metal" means calcium, barium, magnesium, and strontium.

The term "calcium base" refers to a calcium hydroxide, calcium oxide, calcium alkoxide and the like and mixtures thereof.

The term "lime" refers to calcium hydroxide also known as slaked lime or hydrated lime.

The term "Total Base Number" or "TBN" refers to the amount of base equivalent to milligrams of KOH in 1 gram of sample. Thus, higher TBN numbers reflect more alkaline products and therefore a greater alkalinity reserve. The TBN of a sample can be determined by ASTM Test No. D2896 or any other equivalent procedure.

The term "overbased calcium sulfurized alkylphenate composition" refers to a composition comprising a small amount of diluent (e.g., lubricating oil) and a calcium sulfurized alkylphenate complex wherein additional alkalinity is provided by a stoichiometric excess of a calcium oxide, hydroxide or $C_1$ to $C_6$ alkoxide based on the amount required to react with the hydroxide moiety of the sulfurized alkylphenol.

The term "normal calcium sulfurized alkylphenate" refers to a calcium sulfurized alkylphenate which contains a stoichiometric amount of calcium required to neutralize the hydroxy substituent. Such phenates are actually basic and typically exhibit a TBN of about 50 to 150 and are useful to neutralize engine acids.

The term "moderately overbased calcium sulfurized alkylphenate" refers to an overbased sulfurized alkylphenate having a TBN of about 150 to 225.

The term "high TBN, overbased calcium sulfurized alkylphenate compositions" refers to overbased calcium sulfurized alkylphenate compositions having a TBN of about 225 to 350. Generally a carbon dioxide treatment is required to obtain high TBN overbased calcium sulfurized alkylphenate compositions resulting in what is believed to be a complex of the phenate with a colloidal dispersion of calcium carbonate.

The term "lower alkanoic acid" refers to alkanoic acids having 1 through 3 carbon atoms, i.e., formic acid, acetic acid and propionic acid and mixtures thereof.

The term "oil solubility" means that the additive has a solubility of at least 50 grams per kilogram and preferably at least 100 grams per kilogram at 20° C. in a base 10W40 lubricating oil.

The term "alkylphenol" refers to a phenol group having one or more alkyl substituents at least one of which has a sufficient number of carbon atoms to impart oil solubility to the resulting phenate additive.

The term "polyol promoter" refers to a compound having two or more hydroxy substituents, generally the sorbitol type, for example, alkylene glycols and also derivatives thereof and functional equivalents such as polyol ethers and hydroxycarboxylic acids.

SYNTHESIS

The present process can be conveniently conducted by contacting the desired alkylphenol with sulfur in the presence of a lower alkanoic acid and calcium base under reactive conditions preferably in an inert compatible liquid hydrocarbon diluent. Preferably the reaction is conducted under an inert gas, typically nitrogen. In theory the neutralization can be conducted as a separate step prior to sulfurization, but, pragmatically it is generally more convenient to conduct the sulfurization and the neutralization together in a single process step. Also, in place of the lower alkanoic acid, salts of the alkanoic acids or mixtures of the acids and salts could also be used. Where salts or mixtures of salts and acids are used, the salt is preferably an alkaline earth metal salt and most preferably a calcium salt. However, in general the acids are preferred and accordingly, the process will be described below with respect to the use of lower alkanoic acid; however, it should be appreciated that the teachings are also applicable to the use of salts and mixtures of salts in place of all or a portion of the acids.

The combined neutralization and sulfurization reaction is typically conducted at temperatures in the range of about from 115° C. to 250° C. preferably 135° C. to 230° C. depending on the particular alkanoic acid used. Where formic acid is used, we have found that best results are generally obtained by using temperatures in the range of about from 150° C. to 200° C. By using acetic acid or propionic acid, higher reaction temperatures may be advantageously employed and excellent results can be obtained using acetic acid at higher temperatures, for example, at temperatures in the range of about from 180° C. to 250° C.

and especially at temperatures of about from 200° C. to 235° C. Mixtures of two or all three of the lower alkanoic acids also can be used. Mixtures containing about from 5 to 25 wt % formic acid and about from 75 to 95 wt % acetic acid are especially advantageous where normal or moderately overbased products are desired. Based on one mole of alkylphenol typically, about from 0.8 to 3.5, preferably 1.2 to 2 moles of sulfur and about 0.025 to 2, preferably 0.1 to 0.8 moles of lower alkanoic acid are used. Typically about 0.3 to 1 mole preferably, 0.5 to 0.8 mole of calcium base are employed per mole of alkylphenol. In addition an amount of calcium base sufficient to neutralize the lower alkanoic acid is also used. Thus overall, typically about from 0.31 to 2 moles of calcium base are used per mole of alkylphenol including the base required to neutralize the lower alkanoic acid. If preferred, lower alkanoic acid to alkylphenol and calcium base to alkylphenol ratios are used, the total calcium base to alkylphenol ratio range will be about from 0.55 to 1.2 moles of calcium base per mole of alkylphenol. Obviously, this additional calcium base will not be required where salts of alkanoic acids are used in place of the acids. The reaction is also typically and preferably conducted in a compatible liquid diluent, preferably a low viscosity mineral or synthetic oil. The reaction is preferably conducted for a sufficient length of time to ensure complete reaction of the sulfur. This is especially important where high TBN products are desired because the synthesis of such products generally requires using carbon dioxide together with a polyol promoter. Accordingly, any unreacted sulfur remaining in the reaction mixture will catalyze the formation of deleterious oxidation products of the polyol promoter during the overbasing step.

Where the neutralization is conducted as a separate step both the neutralization and the subsequent sulfurization are conducted under the same conditions as set forth above. In either case it is preferred to remove water generated by the neutralization of the alkylphenol. This is conventional and generally is accomplished by continuous distillation during the neutralization. Conveniently, a high molecular weight alkanol having 8 to 16 carbon atoms may be added to the neutralization-sulfurization step and/or the overbasing step as a solvent and also to assist in the removal of water by forming a water-azeotrope which may then be distilled off.

Optionally specialized sulfurization catalysts such as described in U.S. Pat. No. 4,744,921, the disclosure of which is hereby incorporated in its entirety, can be employed in the neutralization-sulfurization reaction together with the lower alkanoic acid. But, in general any benefit afforded by the sulfurization catalyst, for example, reduced reaction time, is offset by the increase in costs incurred by the catalyst and/or the presence of undesired residues in the case of halide catalysts or alkali metal sulfides; especially, as excellent reaction rates can be obtained by merely using acetic and/or propionic acid and increasing reaction temperatures.

If a high TBN product is desired, the sulfurized phenate product can be overbased by carbonation. Such carbonation can be conveniently effected by addition of a polyol promoter, typically an alkylene diol, e.g., ethylene glycol, and carbon dioxide to the sulfurized phenate reaction product. Additional calcium base can be added at this time and/or excess calcium base can be used in the neutralization step. Preferably, an alkenyl succinimide or a neutral or overbased Group II metal hydrocarbylsulfonate is added to either the neutralization-sulfurization reaction mixture or overbasing reaction mixture. The succinimide or sulfonate assists in solubilizing both the alkylphenol and the phenate reaction product and therefore, when used, is preferably added to the initial reaction mixture. Overbasing is typically conducted at temperatures in the range of above from 160° C. to 190° C. preferably 170° C. to 180° C. for about from 0.1 to 4 hours, depending on whether a moderate or high TBN product is desired. Conveniently, the reaction is conducted by the simple expedient of bubbling gaseous carbon dioxide through the reaction mixture. Excess diluent and any water formed during the overbasing reaction can be conveniently removed by distillation either during or after the reaction.

Carbon dioxide is employed in the reaction system in conjunction with the calcium base to form overbased products and is typically employed at a ratio of about from 1 to 3 moles per mole of alkylphenol, and preferably from about 2 to about 3 moles per mole of alkylphenol. Preferably, the amount of $CO_2$ incorporated into the calcium overbased sulfurized alkylphenate provides for a $CO_2$ to calcium weight ratio of about from 0.65:1 to about 0.73:1. All of the calcium base including the excess used for overbasing may be added in the neutralization or a portion of the Group II base can be added prior to carbonation.

Where a moderate TBN product (a TBN of about 150 to 225) is desired, a stoichiometric amount or slight excess of calcium base can be used in the neutralization step; for example, about from 0.5 to 1.3 moles of base per mole of alkylphenol in addition to the amount needed to neutralize the lower alkanoic acid. High TBN products are typically prepared by using a mole ratio of calcium base to alkylphenol of about 1 to 2.5 preferably about 1.5 to 2; a carbon dioxide mole ratio of about 0.2 to 2 preferably 0.4 to 1 moles of carbon dioxide per mole of alkylphenol and about 0.2 to 2, preferably 0.4 to 1.2 moles of alkylene glycol. Again where lower alkanoic acids are used, in contrast to their salts, an additional amount of calcium salt sufficient to neutralize the lower alkanoic acid should be used. As noted above all of the excess calcium base needed to produce a high TBN product can be added in the neutralization-sulfurization step or the excess above that needed to neutralize the alkylphenol can be added in the overbasing step or divided in any proportion between the two steps. Typically where very high TBN products are desired a portion of the calcium base will be added in the overbasing step. The neutralization reaction mixture or overbasing reaction mixture preferably also contains about from 1 to 20, preferably 5 to 15 weight percent of a neutral or overbased sulfonate and/or an alkenyl succinimide based on the weight of alkylphenol. (In general where high TBN are desired, TBN in the range of about from 250 to 300 are preferred.)

Typically, the process is conducted under vacuum up to a slight pressure, i.e., pressures ranging from about 25 mm Hg absolute to 850 mm Hg absolute and preferably, is conducted under vacuum to reduce foaming up to atmospheric pressure, e.g., about from 40 mm Hg absolute to 760 mm Hg absolute.

Additional details regarding the general preparation of sulfurized phenates can be had by reference to the various publications and patents in this technology such as, for example, U.S. Pat. Nos. 2,680,096; 3,178,368 and 3,801,507. The relevant disclosures and these patents are hereby incorporated by reference in their entirety.

Considering now in detail, the reactants and reagents used in the present process, first all allotropic forms of sulfur can be used. The sulfur can be employed either as molten sulfur or as a solid (e.g., powder or particulate) or as a solid suspension in a compatible hydrocarbon liquid.

Preferably, the calcium base used is calcium hydroxide because of its handling convenience versus, for example, calcium oxide, and also because it affords excellent results. Other calcium bases can also be used, for example, calcium alkoxides.

Suitable alkylphenols which can be used in this invention are those wherein the alkyl substituents contain a sufficient number of carbon atoms to render the resulting calcium overbased sulfurized alkylphenate composition oil-soluble. Oil solubility may be provided by a single long chain alkyl substitute or by a combination of alkyl substituents. Typically the alkylphenol used in the present process will be a mixture of different alkylphenol, e.g., $C_{20}$–$C_{24}$ alkylphenol. Where phenate products having a TBN of 275 or less are desired, it is economically advantageous to use 100% polypropenyl substituted phenol because of its commercial availability and generally lower costs. Where higher TBN phenate products are desired, preferably about 25 to 100 mole percent of the alkylphenol will have straight-chain alkyl substituent of from 15 to 35 carbon atoms and from about 75 to 0 mole percent in which the alkyl group is polypropenyl of from 9 to 18 carbon atoms. More preferably in about 35 to 100 mole percent of the alkylphenol, the alkyl group will be a straight-chain alkyl of about 15 to 35 carbon atoms and about from 65 to 0 mole percent of the alkylphenol, the alkyl group will be polypropenyl of from 9 to 18 carbon atoms. The use of an increasing amount of predominantly straight chain alkylphenols results in high TBN products generally characterized by lower viscosities. On the other hand, while polypropenylphenols are generally more economical than predominantly straight chain alkylphenols, the use of greater than 75 mole percent polypropenylphenol in the preparation of calcium overbased sulfurized alkylphenate compositions generally results in products of undesirably high viscosities. However, use of a mixture of from 75 mole percent or less of polypropenylphenol of from 9 to 18 carbon atoms and from 25 mole percent or more of predominantly straight chain alkylphenol of from 15 to 35 carbon atoms allows for more economical products of acceptable viscosities.

Preferably, the alkylphenols are para-alkylphenates or ortho alkylphenols. Since it is believed that p-alkylphenols facilitate the preparation of highly overbased calcium sulfurized alkylphenate where overbased products are desired, the alkylphenol is preferably predominantly a para alkylphenol with no more than about 45 mole percent of the alkylphenol being ortho alkylphenols; and more preferably no more than about 35 mole percent of the alkylphenol is ortho alkylphenol. Alkyl-hydroxy toluenes or xylenes, and other alkyl phenols having one or more alkyl substituents in addition to at least one long chained alkyl substituent can also be used.

In general the present process introduces no new factor or criteria for the selection of alkylphenols and accordingly the selection of alkylphenols can be based on the properties desired for lubricating oil compositions, notably TBN, and oil solubility, and the criteria used in the prior art or similar sulfurization overbasing process and/or processes.

For example, in the case of alkylphenate having substantially straight chain alkyl substituents, the viscosity of the alkylphenate composition can be influenced by the position of an attachment on alkyl chain to the phenyl ring, e.g., end attachment versus middle attachment. Additional information regarding this and the selection and preparation of suitable alkylphenols can be had for example from U.S. Pat. Nos. 5,024,773, 5,320,763; 5,318,710; and 5,320,762, all of which are hereby incorporated by reference in their entirety.

If a supplemental sulfurization catalyst, such as for example desired in U.S. Pat. No. 4,744,921, is employed, it is typically employed at from about 0.5 to 10 wt % relative to the alkylphenol in the reaction system supplemental and preferably at from about 1 to 2 wt %. In a preferred embodiment, the sulfurization catalyst is added to the reaction mixture as a liquid. This can be accomplished by dissolving the sulfurization catalyst in molten sulfur or in the alkylphenol as a premix to the reaction.

The overbasing procedure used to prepare the high TBN calcium overbased sulfurized alkylphenate compositions of this invention also employs a polyol promoter, typically a $C_2$ to $C_4$ alkylene glycol, preferably ethylene glycol in the overbasing step.

Suitable high molecular weight alkanol which can be used in the neutralization-sulfurization and overbasing are those containing 8 to 16, preferably 9 to 15, carbon atoms. Where employed the alkanol is typically employed at a molar charge of from about 0.5 to 5 moles preferably, from about 0.5 to 4 moles and more preferably about 1 to 2 moles of high molecular alkanol per mole of alkylphenol. Examples of suitable alkanols include 1-octanol, 1-decanol (decyl alcohol), 2-ethyl-hexanol, and the like. It is beneficial to use a high molecular weight alcohol in the process because it acts as a solvent and also forms an azeotrope with water and hence facilitates affords a convenient way to remove the water generated by the neutralization or any other water in the system, by azeotropic distillation either after or preferably during the reaction. The high molecular weight alcohol may also play some part in the chemical reaction mechanism in the sense that it facilitates the removal of the byproduct water during the reaction, thus pushing the reaction to the right of the reaction equation.

Suitable Group II metal neutral or overbased hydrocarbyl sulfonates include natural or synthetic hydrocarbyl sulfonates such as petroleum sulfonate, synthetically alkylated aromatic sulfonates, or aliphatic sulfonates such as those derived from polyisobutylene. These sulfonates are well-known in the art. (Unlike phenates "normal" sulfonates are neutral and hence are referred to as neutral sulfonates.) The hydrocarbyl group must have a sufficient number of carbon atoms to render the sulfonate molecule oil soluble. Preferably, the hydrocarbyl portion has at least 20 carbon atoms and may be aromatic or aliphatic, but is usually alkylaromatic. Most preferred for use are calcium, magnesium or barium sulfonates which are aromatic in character. Such sulfonates are conventionally used to facilitate the overbasing by keeping the calcium base in solutions.

Sulfonates suitable for use in the present process are typically prepared by sulfonating a petroleum fraction having aromatic groups, usually mono- or dialkylbenzene groups, and then forming the metal salt of the sulfonic acid material. The sulfonates can optionally be overbased to yield products having Total Base Numbers up to about 400 or more by addition of an excess of a Group II metal hydroxide or oxide and optionally carbon dioxide. Calcium hydroxide or oxide is the most commonly used material to produce the basic overbased sulfonates.

When employed, the Group II metal neutral or overbased hydrocarbyl sulfonate is employed at from about 1 to 20 wt % relative to the alkylphenol, preferably from about 1 to 10 wt %. Where the product is intended as an additive for marine crankcase lubricated oil formulations the use of Group II metal neutral or overbased hydrocarbyl sulfonate described above are especially attractive because sulfonates are advantageously employed in such formulations in conjunction with the calcium overbased sulfurized alkylphenates.

Alternatively, in lieu of a Group II metal neutral or overbased hydrocarbyl or in combination therewith, an alkenyl succinimide may be employed. Alkenyl succinimides are well-known in the art. The alkenyl succinimides are the reaction product of a polyolefin polymer-substituted succinic anhydride with an amine, preferably a polyalkylene polyamine. The polyolefin polymer-substituted succinic anhydrides are obtained by reaction of a polyolefin polymer or a derivative thereof with maleic anhydride. The succinic anhydride thus obtained is reacted with the amine compound. The preparation of the alkenyl succinimides has been described many times in the art. See, for example, U.S. Pat. Nos. 3,390,082; 3,219,666; and 3,172,892, the disclosure of which are incorporated herein by reference. Alkyl succinimides are intended to be included within the scope of the term "alkenyl succinimide". The alkenyl group of the alkenyl succinic anhydride is derived from an alkene, preferably polyisobutene, and is obtained by polymerizing an alkene (e.g., isobutene) to provide for a polyalkene which can vary widely in its compositions. The average number of carbon atoms in the polyalkene and hence the alkenyl substituent of the succinic anhydride can range from 30 or less to 250 or more, with a resulting number average molecular weight of about 400 or less to 3,000 or more. Preferably, the average number of carbon atoms per polyalkene molecule will range from about 50 to about 100 with the polyalkenes having a number average molecular weight of about 600 to about 1,500. More preferably, the average number of carbon atoms in the polyalkene molecule ranges from about 60 to about 90 and the number average molecular weight ranges from about 800 to 1,300. Further information regarding the preparation of alkenyl succinimides and the succinic anhydride precursors can be had, for example, by reference to U.S. Pat. No. 4,744,921 and the references cited therein.

It is generally advantageous to use a small amount of an inert hydrocarbon diluent in the process to facilitate mixing and handling of the reaction mixture and product. Typically, a mineral oil will be used for this purpose because of its obvious compatibility with the use of the product in lubricating oil combinations. Suitable lubricating oil diluents which can be used include for example, solvent refined 100N, i.e., Cit-Con 100N, and hydrotreated 100N, i.e., RLOP 100N, and the like. The inert hydrocarbon diluent preferably has a viscosity of from about 1 to about 20 cSt at 100° C.

In the general preparation of overbased calcium sulfurized alkylphenates, demulsifiers are frequently added to enhance the hydrolytic stability of the overbased calcium sulfurized alkylphenate and may be similarly employed in the present process if desired. Suitable demulsifiers which can be used include, for example, nonionic detergents such as, for example, sold under the Trademark Triton X-45 and Triton X- 100 by Rohm and Haas (Philadelphia, Pa.) and ethoxylated p-octylphenols. Other suitable commercially available demulsifiers include Igepal CO-610 available from GAF Corporation (New York, N.Y.). Where used, demulsifiers are generally added at from 0.1 to 1 wt % to the alkylphenol, preferably at from 0.1 to 0.5 wt %.

LUBRICATING OIL COMPOSITIONS

The oil-soluble, calcium overbased sulfurized alkylphenate compositions produced by the process of this invention are useful lubricating oil additives imparting detergency and dispersancy properties to the lubricating oil as well as providing an alkalinity reserve in the oil without adding polyol oxidation products. When employed in this manner, the amount of the oil-soluble, calcium overbased sulfurized alkylphenate composition ranges from about 0.5 to 40 wt % of the total lubricant composition although preferably from about 1 to 25 wt % of the total lubricant composition. Such lubricating oil compositions are useful in diesel engines, gasoline engines as well as in marine engines. As noted above when used in lubricating oil formulations for marine engines, such phenates are frequently used in combination with Group II metal overbased natural or synthetic hydrocarbyl sulfonates.

Such lubricating oil compositions employ a finished lubricating oil which may be single or multigrade. Multigrade lubricating oils are prepared by adding viscosity index (VI) improvers. Typical viscosity index improvers are polyalkyl methacrylates, ethylene, propylene copolymers, styrene-diene copolymers, and the like. So-called dispersant VI improvers which exhibit dispersant properties as well as VI modifying properties can also be used in such formulations.

The lubricating oil, or base oil, used in such compositions may be mineral oil or synthetic oils of viscosity suitable for use in the crankcase of an internal combustion engine such as gasoline engines and diesel engines which include marine engines. Crankcase lubricating oils ordinarily have a viscosity of about 1300 cSt 0° F. to 24 cSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity such as didodecyl benzene, can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 wt % hydrogenated 1-decene trimer with 75 to 90 wt % 150 SUS (100° F.) mineral oil gives an excellent lubricating oil base.

Other additives which may be present in the formulation include rust inhibitors, foam inhibitors, corrosion inhibitors, metal deactivators, pour point depressants, antioxidants, and a variety of other well-known additives.

A further understanding of the invention can be had from the following non-limiting examples.

EXAMPLE 1

250 TBN Overbased Calcium Sulfurized Alkylphenate

This example illustrates a procedure according to the invention for preparing the title composition using an acetic acid catalyzed sulfurization reaction.

Reaction

In this example a reaction vessel with overhead stirrer and nitrogen flow is charged with 1220 gms of propylene tetramer alkylphenol, 400 gms of a 100 Neutral diluent oil, gms glacial acetic acid, 200 gms sulfur powder and 198 gms of calcium hydroxide. The mixture is heated with stirring from room temperature (about 20°–25° C.) to 200° C. over 4 hours and then maintained at 200° C. for another hour. A portion of the water produced by the neutralization is continuously distilled off during the reaction. A slurry of 380 gms of calcium hydroxide and 122 gms of a neutral sulfonate in 600 gms diluent and 352 gms decyl alcohol is then added over about one minute. The temperature of the mixture is raised to 175° C. and 277 gms of ethylene glycol were added over 20 minutes. 173 gms of carbon dioxide is bubbled through the mixture over 2 hours with rapid stirring. The water generated by the neutralization forms an azeotrope with the decyl alcohol which is distilled off by the following procedure:

Distillation

The temperature is raised from 175° C. to 240° C. over 45 minutes at 8 psia where it was held 30 minutes. About 600 mls of distillate is collected. The concentrate is filtered over diatomaceous earth and diluted to 250 TBN with diluent oil. About 3200 Kg of the product is collected.

EXAMPLE 2

250 TBN Overbased Calcium Sulfurized Alkylphenate

This example illustrates a procedure, according to the invention, for preparing the title composition using a formic acid catalyzed sulfurization reaction.

Reaction

In this example a reaction vessel with overhead stirrer and nitrogen flow is charged with 1220 gms of propylene tetramer alkylphenol, 400 gms of a 100 neutral diluent oil, and gms formic acid, 200 gms sulfur powder and 198 gms of calcium hydroxide. The mixture is heated with stirring from room temperature to 170° C. over 3.5 hours and then held at 170° C. for another 2 hours. A portion of the water produced by the neutralization is continuously distilled off during the reaction. Then a slurry of 380 gms of calcium hydroxide and 122 gms of a neutral sulfonate in 600 gms diluent oil and 352 gms decyl alcohol is then added over about one minute. The temperature is raised to 175° C. and 277 gms of ethylene glycol is added over 20 minutes. 173 gms of carbon dioxide is bubbled through the mixture over 2 hours with rapid stirring. The water generated by the neutralization forms an azeotrope with the decyl alcohol which in turn can be distilled off by the following procedure:

Distillation

The temperature is raised from 175° C. to 240° C. over 45 minutes at 8 psia where it was held 30 minutes. The distillate is collected. The concentrate is filtered over diatomaceous earth and diluted to 250 TBN with diluent oil.

EXAMPLE 3

125 TBN Calcium Sulfurized Alkylphenate

This example illustrates a procedure according to the invention for preparing the title composition using a mixture of acetic acid and formic acid as the sulfurization reaction catalyst. A 2 liter vessel with overhead stirrer and nitrogen flow is charged with 773 gms of propylene tetramer alkylphenol, 235 gms 100 Neutral diluent oil, 125 gms calcium hydroxide, 135 gms sulfur and 15 gms of a 50 wt % formic acid—50 wt % acetic acid mixture. The reaction mixture is heated to 200° C. over 4 hours and held at 400° C. for another 4 hours. A portion of the water produced by the neutralization is continuously distilled off. The mixture is then distilled under vacuum at 1 psia (about 52 mm Hg absolute) for 0.5 hour. About gms of distillate is collected. The concentrate is cooled to 180° C., filtered over diatomaceous earth and diluted to 125 TBN with diluent oil.

EXAMPLE 4

125 TBN Calcium Sulfurized Alkylphenate

This example illustrates a procedure according to the invention for preparing the title composition using a sulfurization reaction catalyst by a mixture of acetic acid and formic acid. A 2 liter vessel with overhead stirrer and nitrogen flow is charged with 1391 gms of propylene tetramer alkylphenol, 842 gms 100 Neutral diluent oil, 219 gms calcium hydroxide, 236 gms sulfur and 63 gms of a 10 wt % formic acid—90 wt % acetic acid mixture. The reaction mixture is heated to 200° C. over 4 hours and held at 400° C. for another 4 hours. A portion of the water produced by the neutralization is continuously distilled off. The mixture is then distilled under vacuum at 1 psia (about 52 mm Hg absolute) for 0.5 hour. The concentrate is cooled to 180° C., filtered over diatomaceous earth and diluted to 125 TBN with diluent oil.

EXAMPLE 5

Determination of Oxalate Concentration

The oxalate concentrations of the calcium overbased sulfurized alkylphenate products of Examples 1 and 2 and a commercial high TBN calcium overbased alkylphenate concentrate, designated Sample "A" prepared using ethylene glycol in the sulfurization reaction were determined by the procedure described below in Table 1.

Oxalate presence in the overbased phenate composition is determined by the presence of an infrared peak at 1660 $cm^{-1}$ and the concentration of the oxalate is determined by peak intensity by first diluting the overbased phenate with diluent oil until a 50 TBN product is achieved. A small amount of the resulting composition is then placed in a 0.2 millimeter (nominal thickness) infrared cavity cell (e.g., sodium chloride plate). A 0.2 millimeter (nominal thickness) sodium chloride reference cavity cell containing only diluent oil was also prepared.

The cells were scanned on a Perkin Elmer Model 281 Infrared Spectrophotometer using the two sodium chloride cells, slit N and scan speed 12 minutes. The infrared spectra from 2000 to 1500 $cm^{-1}$ is determined for the sample. The X axis of the IR spectra measures $cm^{-1}$ and the Y axis measures absorbance in absorbance units. The peak at 1660 $cm^{-1}$ is due to oxalate formation. The actual determination or calculation of oxalate absorbent number is made by a machine which subtracts the oxalate spectrum from the reference spectrum and then scales the net absorbance to a standard 0.2000 mm cell using the appropriate cell path length inputted into the machine.

The oxalate concentrations for Examples 1 and 2 and the comparison commercial sample (Sample A) are reported in Table 1 hereinbelow.

TABLE 1

| Example No. | TBN | Oxalate Absorbent Number |
|---|---|---|
| 1 | 250 | 0.17 |
| 2 | 250 | 0.21 |

TABLE 1-continued

| Example No. | TBN | Oxalate Absorbent Number |
|---|---|---|
| Sample A | 250 | 0.4 |

Obviously many modifications and variations of the invention described herein can be made without departing from the essence and scope thereof.

What is claimed is:

1. A process for preparing a calcium sulfurized alkylphenate composition having a TBN of about from 50 to 150 which is substantially free of polyol promoter oxidation products which comprises contacting an alkylphenol, having at least one alkyl substituent having from 6 to 36 carbon atoms with sulfur, in the presence of a promoter selected from the group of alkanoic acids having 1 through 3 carbon atoms, mixtures of said alkanoic acids and alkaline earth metal salts of alkanoic acids and mixtures thereof and at least a stoichiometric amount of a calcium base sufficient to neutralize said alkylphenol and said carboxylic acid at temperatures in the range of about 130° C. to 250° C. under reactive conditions, in the absence of a polyol promoter or a $C_1$–$C_5$ monohydric alkanol for a sufficient period of time to react essentially all of the sulfur thereby yielding a calcium sulfurized alkylphenate reaction product mixture essentially free of elemental sulfur.

2. The process according to claim 1 wherein said process is conducted using about from 0.8 to 3.5 moles of said sulfur, 0.025 to 2 moles of said promoter and 0.4 to 2 moles of said calcium base per mole of said alkylphenol and about 0.5 moles of calcium base per mole of said carboxylic acid and a minor amount of an inert organic liquid diluent.

3. The process according to claim 2 wherein said process is conducted at pressures in the range of about from 25 mm Hg absolute to 850 mm Hg absolute.

4. The process according to claim 2 wherein said promoter is a carboxylic acid and is selected from the group of acetic acid, propionic acid, mixtures of acetic and propionic acid and mixtures thereof with formic acid.

5. The process according to claim 4 wherein said process is conducted at temperatures in the range of about from 170° C. to 250° C.

6. The process according to claim 4 wherein said promoter is selected from the group of acetic acid, propionic acid and mixtures thereof and said process is conducted at temperatures in the range of about from 190° C. to 250° C.

7. The process according to claim 2 wherein said carboxylic acid is a mixture of formic acid and acetic acid and said process is conducted at temperatures in the range of about from 130° C. to 250° C.

8. The process according to claim 7 wherein said carboxylic acid is a mixture containing about from 5 to 25 wt % formic acid and about from 75 to 95 wt % acetic acid.

9. The process according to claim 2 wherein said promoter is formic acid and said process is conducted at temperatures of about from 130° C. to 175° C.

10. The process according to claim 1, wherein said promoter is selected from the group of calcium formate, calcium acetate, calcium propionate and mixtures thereof.

11. The process of claim 1 wherein said process is conducted in the presence of an alkanol having 6 to 16 carbon atoms and a neutral or overbased Group II metal organic sulfonate or an alkenyl succinimide.

12. A process for preparing a calcium overbased sulfurized alkylphenate composition having a TBN of about from 200 to 350 which is substantially free of polyol promoter oxidation products, which comprises the steps of:

a) Contacting an alkylphenol, having at least one alkyl substituent from 6 to 36 carbon atoms with sulfur, in the presence of a promoter acid selected from the group of alkanoic acids having 1 through 3 carbon atoms mixtures of said alkanoic acids, alkaline earth metal salts of said alkanoic acids and mixtures thereof, and at least a stoichiometric amount of a calcium base sufficient to neutralize said alkylphenol and said promoter at temperatures in the range of about 130° C. to 250° C. under reactive conditions in the absence of a polyol promoter or an alkanol having 1 to 5 carbon atoms for a sufficient period of time to react essentially all of said sulfur thereby yielding a calcium sulfurized alkylphenate essentially free of elemental sulfur;

b) Contacting the reaction product of step a) with carbon dioxide and additional calcium base, if required to provide the desired TBN, in the presence of an alkylene glycol having 2 to 6 carbon atoms under reactive conditions at temperatures in the range of about from 200° C. to 260° C.

13. The process according to claim 12 wherein step a) is conducted using about from 0.8 to 3.5 moles of said sulfur, 0.025 to 2 moles of said promoter and 0.5 to 2 moles of said calcium per mole of said alkylphenol and 0.5 mole of said calcium base per mole of said alkanoic acid and a minor amount of an inert organic liquid diluent.

14. The process according to claim 13 wherein step b) is conducted in situ with the reaction product mixture of step a) and wherein about from 1 to 2 moles of said calcium base, about 0.2 to 2 moles of carbon dioxide and 0.2 to 2 moles of said alkylene glycol per moles of said alkylphenol and wherein said alkylene glycol is ethylene glycol.

15. The process according to claim 14 wherein said steps a) and b) are conducted at pressures in the range of about from 25 mm Hg absolute to 850 mm Hg absolute.

16. The process according to claim 14 wherein said promoter is selected from the group of formic acid, acetic acid and mixtures thereof.

17. The process according to claim 14 wherein said promoter is formic acid and step a) is conducted at temperatures of about from 130° C. to 175° C.

18. The process according to claim 14 wherein said promoter is selected from acetic acid, propionic acid, mixtures of acetic acid and propionic acid and mixtures thereof with formic acid and step a) is conducted at temperatures in the range of about from 170° C. to 250° C.

19. The process according to claim 18 wherein said promoter is selected from the group of acetic acid, propionic acid and mixtures thereto and wherein step a) is conducted at temperatures in the range of about from 190° C. to 250° C.

20. The process according to claim 12, wherein said promoter is selected from the group of calcium formate, calcium acetate, calcium propionate and mixtures thereof.

21. The process of claim 12 wherein step a) is conducted in the presence of a higher alkanol having 6 to 16 carbon atoms and a neutral or overbased alkaline earth metal organic sulfonate or an alkenyl succinimide and step b) is conducted in situ with the reaction product mixture of step a) and wherein water formed by the neutralization of said alkylphenol is removed prior to step b).

* * * * *